US008197895B2

(12) United States Patent
Arndt et al.

(10) Patent No.: US 8,197,895 B2
(45) Date of Patent: Jun. 12, 2012

(54) METHOD AND DEVICE FOR THE COLD-GAS SPRAYING OF PARTICLES HAVING DIFFERENT SOLIDITIES AND/OR DUCTILITIES

(75) Inventors: Axel Arndt, Berlin (DE); Uwe Pyritz, Berlin (DE); Heike Schiewe, Berlin (DE); Raymond Ullrich, Schönwalde (DE)

(73) Assignee: Siemens Aktiengesellschaft, Munich (DE)

( * ) Notice: Subject to any disclaimer, the term of this patent is extended or adjusted under 35 U.S.C. 154(b) by 364 days.

(21) Appl. No.: 12/521,342

(22) PCT Filed: Jan. 7, 2008

(86) PCT No.: PCT/EP2008/050087

§ 371 (c)(1), (2), (4) Date: Jun. 26, 2009

(87) PCT Pub. No.: WO2008/084025

PCT Pub. Date: Jul. 17, 2008

(65) Prior Publication Data

US 2010/0040775 A1 Feb. 18, 2010

(30) Foreign Application Priority Data

Jan. 9, 2007 (DE) ..... 10 2007 001 477

(51) Int. Cl.
*B05D 1/12* (2006.01)
*B05B 7/14* (2006.01)

(52) U.S. Cl. ..... 427/201; 427/190; 427/191; 118/311

(58) Field of Classification Search ..... 427/190, 427/191, 201; 118/311
See application file for complete search history.

(56) References Cited

U.S. PATENT DOCUMENTS

| | | | | |
|---|---|---|---|---|
| 5,985,373 | A * | 11/1999 | Chernyshov | 427/201 |
| 2003/0126800 | A1 | 7/2003 | Seth et al. | 51/293 |
| 2004/0037954 | A1 | 2/2004 | Heinrich et al. | 427/180 |
| 2007/0098912 | A1 * | 5/2007 | Raybould et al. | 427/446 |
| 2007/0221746 | A1 * | 9/2007 | Heinrich et al. | 239/135 |

FOREIGN PATENT DOCUMENTS

DE 102005004116 A1 4/2006

(Continued)

OTHER PUBLICATIONS

International PCT Search Report, PCT/EP2008/050087, 3 pages, mailed Mar. 24, 2009.

(Continued)

*Primary Examiner* — Frederick Parker
(74) *Attorney, Agent, or Firm* — King & Spalding L.L.P.

(57) ABSTRACT

In a method for the cold-gas spraying of particles having different solidities and/or ductilities and in a cold-gas spraying device (11) suitable for use in with the method, in order to obtain a comparatively high proportion of particles (23) having higher solidity and/or smaller ductility in comparison to the other particles (22), these particles are fed into an area (21) of the stagnation chamber (15) of the cold-gas spraying device which is very distant from the nozzle (14). Advantageously, the particles (23) have to cover a longer course through the stagnation chamber and are thus preheated. In this way, the deposition of these particles (23) on a substrate (25) is improved. Particularly metals having a transition temperature ranging between brittle and ductile behavior can be provided with ductile properties by the preheating process, thereby simplifying the deposition process.

19 Claims, 1 Drawing Sheet

FOREIGN PATENT DOCUMENTS

| | | | |
|---|---|---|---|
| EP | 1403396 | A1 | 3/2004 |
| EP | 1579921 | A2 | 9/2005 |
| EP | 1712657 | A2 | 10/2006 |
| EP | 1712657 | A3 | 7/2007 |
| EP | 1925693 | A2 | 5/2008 |
| RU | 2087207 | C1 | 8/1997 |
| RU | 2128728 | C1 | 4/1999 |
| RU | 2194091 | C2 | 12/2002 |
| RU | 2218425 | C2 | 12/2003 |
| WO | 2006/034777 | A1 | 4/2006 |

OTHER PUBLICATIONS

Ernst, R., Hard material und Hartstoff, German to English Dictionary of Industrial Technology "Wörterbuch der Industriellen Technologie", German Dictionary—Brockhaus Naturwissenschaft und Technik, pp. 460 and 880.

* cited by examiner

METHOD AND DEVICE FOR THE COLD-GAS SPRAYING OF PARTICLES HAVING DIFFERENT SOLIDITIES AND/OR DUCTILITIES

CROSS-REFERENCE TO RELATED APPLICATIONS

This application is a U.S. National Stage Application of International Application No. PCT/EP2008/050087 filed Jan. 7, 2008, which designates the United States of America, and claims priority to German Application No. 10 2007 001 477.7 filed Jan. 9, 2007, the contents of which are hereby incorporated by reference in their entirety.

TECHNICAL FIELD

The invention relates to a cold gas spraying process, in which particles of a first type together with particles of a second type are fed into a stagnation chamber and are accelerated, together with a carrier gas, through a nozzle connected downstream of the stagnation chamber onto a substrate to be coated. In the process, the particles of the first type deform and remain adhering to form a layer, wherein the particles of the second type, which have a higher solidity and/or a lower ductility than the particles of the first type, are incorporated into the layer.

BACKGROUND

The process mentioned in the introduction is known, for example, from U.S. 2003/0126800 A1. According to this process, cold gas spraying is used to deposit particles of a hard material together with particles of a metallic material on the surface of turbine blades or vanes. A proportion of from 15 to 20% of the hard-material particles is embedded in the matrix of the metallic matrix material which forms during the cold gas spraying. On account of their high solidity and low ductility, the hard-material particles remain in an unchanged state in the matrix. This also makes it possible to explain the fact that the incorporation rate of hard materials in proportions of more than 20% is not possible. Specifically, the hard-material particles do not automatically remain adhering to the surface of the substrate to be coated, since the introduction of kinetic energy from the cold gas spraying is not sufficient and the particles are not sufficiently ductile for this purpose. Instead, the hard-material particles are concomitantly incorporated into the matrix of the metallic material which then forms, such that the adhesion is ensured indirectly by the component having the lower solidity or higher ductility.

SUMMARY

According to various embodiments, a cold gas spraying process can be specified by means of which, when particles of different types are used, those particles with the higher solidity and/or with the lower ductility can be introduced into the layer in a comparatively high proportion of the layer.

According to an embodiment, in a cold gas spraying process, in which particles of a first type together with particles of a second type are fed into a stagnation chamber and are accelerated, together with a carrier gas, through a nozzle connected downstream of the stagnation chamber onto a substrate to be coated, the particles of the first type deform and remain adhering to the substrate to form a layer, and wherein the particles of the second type, which have a higher solidity and/or a lower ductility than the particles of the first type, are incorporated into the layer, and the particles of the first type are fed into a first area of the stagnation chamber, which is closer to the nozzle than a second area, into which the particles of the second type are fed.

According to a further embodiment, the particles of the second type can be produced from a brittle material, in particular from a ceramic material. According to a further embodiment, the particles of the second type can be produced from a hard material, in particular tungsten carbide, and in that the substrate coated is a blade or vane for a compressor or a turbine. According to a further embodiment, the particles of the second type can be produced from a metal or a metal alloy which is ductile above a transition temperature and brittle below this temperature, wherein the particles of the second type are heated in the stagnation chamber to such an extent that they have a ductile behavior. According to a further embodiment, the carrier gas can be heated in the stagnation chamber.

According to another embodiment, a cold gas spraying device, may comprise—stagnation chamber having a supply opening for a carrier gas and a first infeed line for particles of a first type intended for coating,—a nozzle connected downstream of the stagnation chamber, and—a second infeed line is provided in the stagnation chamber, wherein the first infeed line issues into a first area of the stagnation chamber, which is closer to the nozzle than a second area, into which the second infeed line issues.

According to a further embodiment, the stagnation chamber may be provided with a heating device. According to a further embodiment, the heating device may be integrated in the wall of the stagnation chamber. According to a further embodiment, the first infeed line and/or second infeed line can be moved in the device in such a way that the distance between the first area and/or second area and the nozzle can be varied.

BRIEF DESCRIPTION OF THE DRAWINGS

Further details of the invention are described below with reference to the drawing, in which.

DETAILED DESCRIPTION

Figure 1:
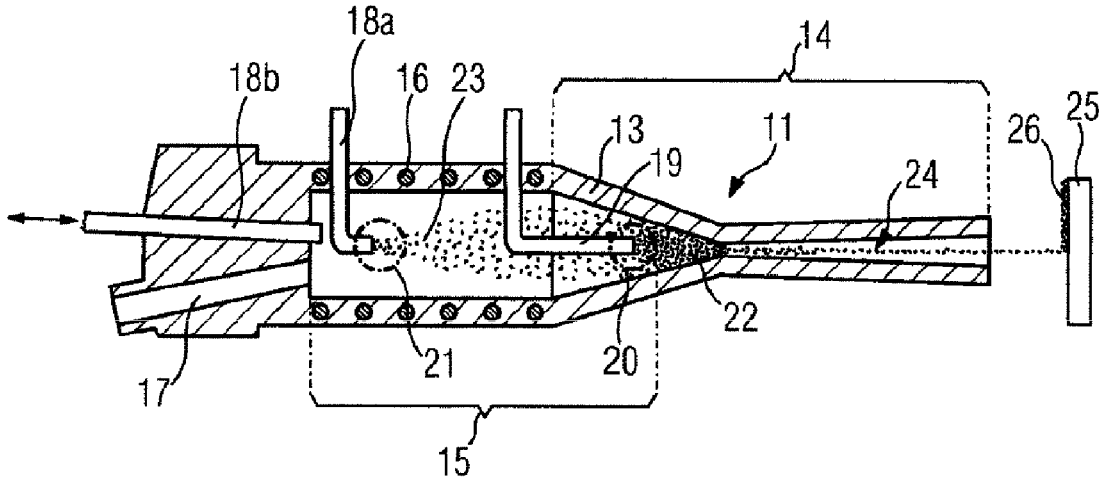
FIG. 1 shows a schematic cross section through an exemplary embodiment of the cold gas spraying device.

According to various embodiments, the particles of the first type are fed into a first area of the stagnation chamber, which is closer to the nozzle than a second area, into which the particles of the second type are fed. This has the advantageous effect that the particles of the second type, which are problematic in terms of high deposition rates on account of the higher solidity and/or lower ductility, experience a more pronounced introduction of energy in the stagnation chamber. This introduction of energy is primarily brought about by the preheated carrier gas in the cold gas jet. Specifically, temperature equalization takes place between the molecules of the carrier gas and the particles located in the stagnation chamber. The longer the particles remain in the stagnation chamber, the more pronounced this equalization becomes. Since the second area, into which the particles of the second type are fed, is further away from the nozzle in the direction of flow of the carrier gas, the introduction of energy into the particles of the second type is greater. This advantageously improves the preconditions for depositing the particles of the second type.

As has been shown, the additional heating of the more solid or less ductile particles may influence the coating process in different ways. According to an embodiment, the particles of the second type may be produced from a brittle material, in particular from a ceramic material. A particularly suitable ceramic material is tungsten carbide; this may preferably be deposited on the blade or vane of a compressor or a turbine in order to increase its service life.

In principle, the additional heating of brittle materials in the stagnation chamber does not change their properties. Nevertheless, it has been found that the heated particles permit higher incorporation rates in a ductile matrix. This is explained by the fact that the particles of the second type are used as thermal energy stores, wherein this thermal energy improves the interplay between the particles of the first and second types at the moment when the brittle particles are incorporated into the ductile matrix. In this respect, the amount of energy introduced into the brittle particles is indirectly made available for building up the layer with the ductile particles.

According to another embodiment, it is provided that the particles of the second type are produced from a metal or a metal alloy which is ductile above a transition temperature and brittle below this temperature, wherein the particles of the second type are heated in the stagnation chamber to such an extent that they have a ductile behavior. If preheating of the particles of the second type makes it possible for these to likewise become ductile, it is advantageously possible to deposit these particles without having to incorporate them into a matrix of another material. This has the advantageous effect that it is possible to increase as desired the proportion of the material that is of a brittle nature, since a matrix of the other layer component which surrounds these particles is no longer required. This advantageously makes it possible to deposit a wider spectrum of alloy compositions by means of cold gas spraying.

According to an embodiment, it is provided that the carrier gas is heated in the stagnation chamber. By way of example, this may be done by providing a heatable outer wall in the stagnation chamber. The additional heating of the carrier gas in the stagnation chamber makes it possible to at least partially replace the amount of energy introduced into the particles of the second type, before the carrier gas is expanded in the nozzle. It is also possible to introduce a certain amount of energy from the heating into the particles of the second type themselves.

Furthermore, according to another embodiment, a cold gas spraying device. Devices of this type are generally known and are disclosed, for example, in U.S. 2004/0037954 A1. A device of this type comprises a stagnation chamber having a supply opening for a carrier gas and a first infeed line for particles intended for coating, wherein these particles are referred to hereinbelow as first particles. In addition, as seen in the direction of flow of the carrier gas, a nozzle is connected downstream of the stagnation chamber, through which nozzle the carrier gas with the particles is expanded in the direction of a substrate to be coated. In this case, the carrier gas is cooled adiabatically, wherein the amount of energy thereby released is converted into an acceleration of the carrier gas and of the particles intended for coating.

As already explained, it is possible to deposit particles having different solidities and/or ductilities only with restrictions.

Furthermore, according to various embodiments, a cold gas spraying device can be specified by means of which it is possible to produce layers into which it is possible to incorporate a comparatively high proportion of particles having a higher solidity and/or a lower ductility than the particles of the first type (referred to hereinbelow as particles of the second type).

According to an embodiment, a second infeed line is provided in the stagnation chamber, wherein the first infeed line issues into a first area of the stagnation chamber, which is closer to the nozzle than a second area, into which the second infeed line issues. This device is suitable for operation on the basis of the process described in more detail above since it has two infeed lines; in this way, the particles of the second type can be made to cover a longer path through the stagnation chamber than the particles of the first type. This makes it possible to preheat the particles of the second type, and this has the associated advantages already mentioned above.

According to an embodiment, the device is provided with a heating device fitted on the stagnation chamber. This makes it possible to directly heat the wall of the stagnation chamber or the interior of the stagnation chamber, as a result of which an additional amount of heat can be introduced into the particles of the second type or of the carrier gas.

Another embodiment provides for the heating device to be integrated in the wall of the stagnation chamber. This has the advantage that the flow conditions inside the stagnation chamber are not impaired and also ensures a short heat transfer path from the heating device to the wall of the stagnation chamber.

One particular embodiment is obtained if the first infeed line and/or second infeed line can be moved in the device in such a way that the distance between the first area and/or second area and the nozzle can be varied. This has the advantage that the quantity of heat which can be transferred by the carrier gas can be controlled by it being possible for the points at which the particles are fed in in the direction of the carrier gas stream to be varied. These points directly influence the length of the path which the particles have to cover through the stagnation chamber to the nozzle, wherein this path is decisive for the quantity of heat which can be transferred.

A cold gas spray gun 11 as a cold gas spraying device constitutes the core element of a thermal spraying device as is described, for example, in U.S. 2004/00347954 A1. The cold gas spray gun 11 substantially comprises a single housing 13, in which a Laval nozzle 14 and a stagnation chamber 15 are formed. In the area of the stagnation chamber 15, a heating coil 16, which heats a carrier gas supplied through a supply opening 17 of the stagnation chamber 15, is embedded in the wall of the housing 13.

The carrier gas passes through the supply opening 17 first into the stagnation chamber 15 and leaves the latter through the Laval nozzle 14. In this case, the carrier gas may be heated up to 800° C. in the stagnation chamber. The particles intended for coating are fed in through a second infeed line 18*a* and a first infeed line 19. An expansion of the carrier gas stream, acted upon by the particles, through the Laval nozzle 14 cools the carrier gas stream, which has temperatures of below 300° C. in the area of the nozzle opening. This reduction in temperature can be attributed to a substantially adiabatic expansion of the carrier gas which has, for example, a pressure of 30 bar in the stagnation chamber and is expanded to atmospheric pressure outside the nozzle opening.

The second infeed line 19 issues into the stagnation chamber in an area which is very close to the nozzle. In the context of this application, the nozzle is that part of the cold spray gun whose cross section initially narrows and then widens again (indicated by the parenthesis at reference symbol 14). The area of the cold spray gun which serves as the stagnation chamber is identified by the parenthesis at reference symbol 15. It is clear from FIG. 1 that the conical area adjoining the cylindrical area of the stagnation chamber can be assigned both to the stagnation chamber 15 and to the nozzle 14. Specifically, the flow conditions between the stagnation chamber and the nozzle merge with one another, wherein the conical wall parts adjoining the cylindrical area initially still form such a large cross section that the flow conditions correspond more to those in the stagnation chamber, i.e. a significant acceleration of the carrier gas and of the particles occurs first in the substantially narrower conical area. Therefore, the second infeed line 19 also issues into this conical area, so that the particles fed in are accelerated, as far as possible without any time delay, in the part significantly acting as the nozzle 14.

The first infeed line 18*a* issues into that part of the stagnation chamber 15 which is remote from the nozzle 14, such that the particles have to pass through the entire stagnation chamber and in the process are heated primarily by the carrier gas. The two points at which the infeed lines 18*a*, 19 are fed in produce a first area 20 and a second area 21 for feeding in the particles of the first type 22 and the particles of the second type 23 (only indicated in FIG. 1). The cold gas jet 24 produced in the nozzle then contains a mixture of the particles of the first type 22 and of the second type 23, and these particles are deposited on a substrate 25 as a layer 26.

As an alternative to the infeed line 18*a*, it is also possible to provide an infeed line 18*b*, which can be moved axially. The infeed point 21 can therefore be moved toward and away from the nozzle 14 by being moved in the direction of the double arrow indicated. This makes it possible to adapt the cold spray gun 11 to the respective application and the quantity of heat required to preheat the particles 23.

Figure 2:
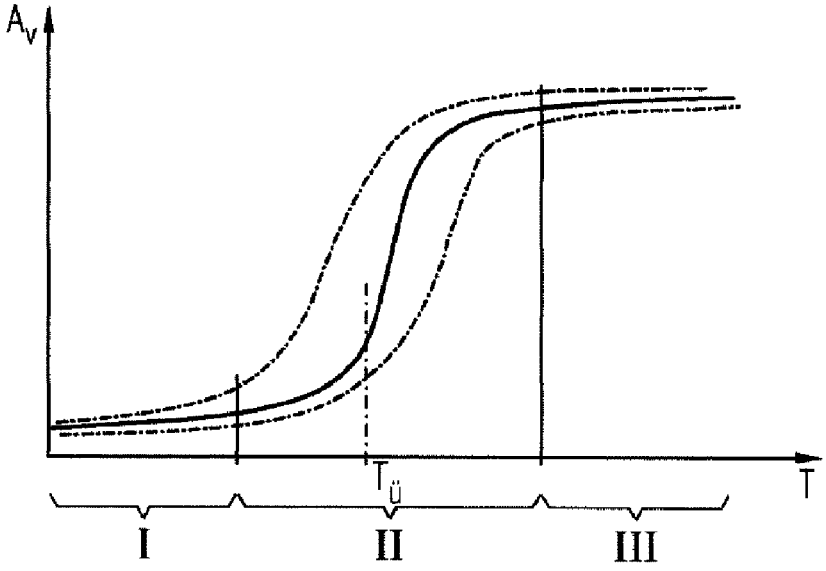
FIG. 2 shows a graph plotting the notched bar impact energy against the temperature for metals having a transition temperature.

FIG. 2 schematically illustrates the temperature-dependent behavior of metals having a transition temperature $T_{ü}$. The temperature T is plotted on the X axis and the notched bar impact energy $A_v$ is plotted on the Y axis. This energy is determined using the so-called notched bar impact bending test, in which a notched sample is exposed to impact stress (for example DIN EN 10045). The behavior of the metals can be divided into three sectors, depending on the rupture behavior. In sector I, there is a brittle rupture, since the metal loses its ductile properties at low temperatures. In sector III, the metal has a ductile behavior and therefore displays the mechanical properties known per se for metals. Situated between sector I and sector III is sector II, in which so-called mixed ruptures which have brittle and ductile components occur. As can be seen from the dash-dotted lines, there is a large spread in the determination of the notched bar impact energy in sector II, since the conditions in the microstructure are chaotic. The values for the notched bar impact energy can be determined more accurately in sectors I and III. The transition temperature $T_{ü}$ is therefore a value which cannot be accurately determined.

Typical metals having a transition temperature are the following:

metals having a body-centered cubic lattice (unalloyed and low alloy steels, chromium, molybdenum), metals having hexagonal lattices (aluminum).

By way of example, unalloyed steels having a carbon content of more than 0.6% by mass already have a transition temperature of between 100 and 200° C., and so they are ideally suited for the process according to various embodiments. Another example is the production of a copper/chromium alloy by means of cold gas spraying. In addition, it is also possible to coat turbine blades or vanes, in which case, for example, tungsten carbide is deposited as hard material together with an MCrAlY alloy.

LIST OF REFERENCE SYMBOLS

11 Particles 1
12 Particles 2
14 Nozzle
15 Stagnation chamber
16 Heating coil
17 Supply opening
18*a*, 18*b* Infeed line
19 Infeed line
20 First area
21 Second area
22 First particles
23 Second particles
25 Substrate
26 Layer

What is claimed is:

1. A cold gas spraying process, comprising the steps of: feeding particles of a first type together with particles of a second type into a stagnation chamber and accelerating the particles, together with a heated carrier gas, through a nozzle connected downstream of the stagnation chamber onto a substrate to be coated, wherein the particles of the first type deform and remain adhering to the substrate to form a layer, and wherein the particles of the second type, which have at least one of a higher hardness and a lower ductility than the particles of the first type, are incorporated into the layer, wherein the particles of the first type are fed into a first area of the stagnation chamber, which is closer to the nozzle than a second area, into which the particles of the second type are fed, wherein due to the first area of the stagnation chamber into which the particles of first type are fed being located closer to the nozzle than the second area of the stagnation chamber into which the particles of second type are fed, the particles of the second type are mixed with the heated carrier gas for longer than the particles of the first type are mixed with the heated carrier gas, such that an introduction of enemy into the particles of the second type from the heated carrier gas is greater than an introduction of energy into the particles of the first type from the heated carrier gas, and wherein the introduction of energy into the particles of the second type from the heated carrier gas increases the incorporation rate of the particles in the layer formed on the substrate.

2. The process according to claim 1, wherein the particles of the second type are produced from a brittle material.

3. The process according to claim 2, wherein the substrate coated is a blade or vane for a compressor or a turbine.

4. The process according to claim 1, wherein the particles of the second type are produced from a metal or a metal alloy which is ductile above a transition temperature and brittle below this temperature, and wherein the particles of the second type are heated in the stagnation chamber to such an extent that they have a ductile behavior.

5. The process according to claim 1, wherein the carrier gas is heated in the stagnation chamber.

6. The process according to claim 2, wherein the brittle material is a ceramic material.

7. The process according to claim 3, wherein the particles of the second type comprise tungsten carbide.

8. The process according to claim 1, wherein the carrier gas is preheated before entering the stagnation chamber.

9. A cold gas spraying device, comprising a stagnation chamber having a supply opening for a carrier gas and a first infeed line for particles of a first type intended for coating, a nozzle connected downstream of the stagnation chamber, and a second infeed line in the stagnation chamber for particles of a second type, wherein the first infeed line issues into a first area of the stagnation chamber, which is closer to the nozzle than a second area, into which the second infeed line issues, wherein the stagnation chamber includes a heating device for heating the carrier gas in the stagnation chamber, wherein due to the first area of the stagnation chamber into which the particles of first type are fed being located closer to the nozzle than the second area of the stagnation chamber into which the particles of second type are fed, the particles of the second type are mixed with the heated carrier gas for longer than the particles of the first type are mixed with the heated carrier gas, such that an introduction of energy into the particles of the second type from the heated carrier gas is greater than an introduction of energy into the particles of the first type from the heated carrier gas, and wherein the introduction of energy into the particles of the second type from the heated carrier gas increases the incorporation rate of the particles in the layer formed on the substrate.

10. The device according to claim 9, wherein the heating device is integrated in the wall of the stagnation chamber.

11. The device according to claim 9, wherein at least one of the first infeed line and second infeed line can be moved in the device in such a way that the distance between at least one of the first area and second area and the nozzle can be varied.

12. A cold gas spraying apparatus, comprising:

a stagnation chamber having a supply opening for a carrier gas, a first infeed line for particles of a first type, and a second infeed line for particles of a second type, wherein the first infeed line issues into a first area of the stagnation chamber, which is closer to the nozzle than a second area into which the second infeed line issues, a heating device integrated in a wall of the stagnation chamber, and a nozzle connected downstream of the stagnation chamber for delivering the carrier gas, particles of the first type, and particles of the second type toward an object to be coated.

13. The apparatus according to claim 12, wherein the particles of the second type are produced from the brittle material.

14. The apparatus according to claim 13, wherein the substrate coated is a b;ade or vane for a compressor or a turbine.

15. The apparatus according to claim 12, wherein the particles of the second type are produced from a metal or a metal alloy which is ductile above a transition temperature and brittle below this temperature, and wherein the particles of the second type are heated in the stagnation chamber to such an extent that they have a ductile behavior.

16. The apparatus according to claim 12, wherein the carrier gas is heated in the stagnation chamber.

17. The apparatus according to claim 13, wherein the brittle material is a ceramic material.

18. The apparatus according to claim 14, wherein the particles of the second type comprise tungsten carbide.

19. A cold gas spraying apparatus, comprising:

a stagnation chamber having a supply opening for a carrier gas, a first infeed line for particles of a first type, and a second infeed line for particles of a second type, wherein the first infeed line issues into a first area of the stagnation chamber, which is closer to the nozzle than a second area into which the second infeed line issues, and a nozzle connected downstream of the stagnation chamber for delivering the carrier gas, particles of the first type, and particles of the second type toward an object to be coated, wherein at least one of the first infeed line and second infeed line can be moved in the device in such a way that the distance between at least one of the first area and second area and the nozzle can be varied.

* * * * *